US005860478A

United States Patent [19]

Coutts et al.

[11] Patent Number: 5,860,478

[45] Date of Patent: Jan. 19, 1999

[54] SUB-SEA TEST TREE APPARATUS

[75] Inventors: Graeme Forbes Coutts; Jeffrey Charles Edwards, both of Aberdeen, Scotland

[73] Assignee: Exploration & Production Services (North Sea) Ltd., Scotland

[21] Appl. No.: 388,162

[22] Filed: Feb. 10, 1995

Related U.S. Application Data

[63] Continuation of Ser. No. 190,059, Mar. 25, 1994, abandoned.

[30] Foreign Application Priority Data

Jul. 30, 1991 [GB] United Kingdom ..... 9116477
Jul. 23, 1992 [WO] WIPO ..... PCT/GB92/01352

[51] Int. Cl.[6] ..... E21B 33/06

[52] U.S. Cl. ..... 166/356; 166/358; 166/363; 175/318; 175/423; 277/3; 251/1.1

[58] Field of Search ..... 175/232, 317, 175/318, 423, 424; 166/75.1, 336, 356, 358, 363; 277/3; 251/1.1, 1.2, 1.3

[56] References Cited

U.S. PATENT DOCUMENTS

| | | | |
|---|---|---|---|
| 3,695,349 | 10/1972 | Murman et al. | 166/84 X |
| 3,955,623 | 5/1976 | Aumann | 166/224 X |
| 4,116,272 | 9/1978 | Barrington | 166/340 |
| 4,159,637 | 7/1979 | Lamb et al. | 73/46 |
| 4,375,239 | 3/1983 | Barrington et al. | 166/336 |
| 4,378,849 | 4/1983 | Wilks | 166/95 X |
| 4,436,157 | 3/1984 | Brooks | 166/344 |
| 4,553,591 | 11/1985 | Mitchell | 166/76 |
| 4,880,060 | 11/1989 | Schwendemann et al. | 166/336 |
| 4,938,290 | 7/1990 | Leggeit et al. | 166/387 |

*Primary Examiner*—Roger J. Schoeppel
*Attorney, Agent, or Firm*—Gifford, Krass, Groh, Sprinkle, Patmore, Anderson & Citkowski, P.C.

[57] ABSTRACT

Apparatus and a method for killing a live well after activation of a well blowout preventer is described. This is achieved by providing apparatus in the form of a shear or kill sleeve (34) in a string (26) above a sub-sea test tree and which is located between the pipe rams (22, 24) and shear rams (18) of a blowout preventer (12). In the event that the shear rams (18) are activated and seal the string above the kill sleeve (34), the sleeve includes a pressure sensitive valve (84) which may be opened, by pressurising between the blowout preventer rams (18, 22), to permit fluid to be pumped from the blowout preventer (12) through the valve (84) and into the string (40), to choke or kill the well. After the well has been killed, the blowout preventer (12) may be opened to permit removal of the well tools. Embodiments of the invention are described.

17 Claims, 4 Drawing Sheets

SUB-SEA TEST TREE APPARATUS

This is a continuation of application(s) Ser. No. 08/190,059 filed on Mar. 25, 1994 now abandoned.

This invention relates to an improved gas or oil well sub-sea test tree and to apparatus for use with a test tree. The invention further relates to a method of killing a live well after activation of the well blowout preventer in which the landing string above the test tree is sheared and the sub-sea test tree valves close to seal off the landing string.

BACKGROUND OF INVENTION

During well testing (drilling) operations and the like, which are carried out from a floating vessel, such as a drillship or semi-submersible, well control is achieved by a sub-sea blowout preventer, which is mounted on the sea-bed to the well head. Such blowout preventers typically comprise a tubular central housing on which are mounted a number of sets of hydraulic rams, for example, four which carry various sealing and cutting tools. The rams are axially spaced along the housing. The lower, or pipe rams, are provided with semi-circular sealing faces, so that when these rams are activated the semi-circular faces mate with the outer surfaces of the well tool. The uppermost set of rams are known as shear rams and are provided with cutting surfaces which can cut through or close the bore of the well tool and isolate the pressurised reservoir fluid from the riser and the upper part of the well tool.

In oil and gas well testing, well pressure control equipment is utilised in addition to the downhole test equipment mounted at the end of the test string, the well pressure control equipment being located above the well head and blowout preventer on the landing string. This equipment provides various safety features and allows for complete well control.

One of the tools utilised in well testing is a sub-sea test tree, a safety valve which is located inside the blowout preventer. During well test operations it is necessary to control both the tubing and annulus pressures, that is the pressure within the string and the pressure between the string and the riser, well casing and well lining. The sub-sea safety tree provides a primary safety system to control tubing pressure and to provide means to disconnect the riser rapidly and safely from the well should adverse conditions occur, such as bad weather or loss of a floating vessels' positioning system. This is partly achieved by providing "fail-safe" valves in the tree, which, for example, are held open during normal operating conditions by supplied hydraulic pressure. If the hydraulic pressure is cut-off, the valves will close, isolating the test string below the tree. An upper portion of the tree may then be unlatched from the lower portion of the tree containing the valves, and the landing string and other well pressure control equipment located above the tree withdrawn.

In situations where a blowout appears likely to occur, the shearing rams of the blowout preventer are activated and seal the string by shearing through the landing string above the sub-sea tree leaving it inside the blowout preventer. The pipe rams are normally extended during well testing and thus also form a seal around the outside of the string. To bring the well back to a safe condition and permit retrieval of the downhole test tools it is necessary to "kill" the live well, such that an uncontrolled flow of fluid will not result when the blowout preventer is opened. This is accomplished by reducing the well pressure, which may be achieved by, for example, pumping a fluid such as barium mud, brine or sea water into the string.

SUMMARY OF INVENTION

One of the-primary objects of this invention is to provide a sub-sea test tree which facilitates killing of a live well after activation of a blowout preventer.

This is achieved by providing apparatus, in the form of a shear or kill sleeve in a string above a sub-sea test tree and which is located between the pipe rams and shear rams of a blowout preventer. In the event that the shear rams are activated and seal the string above the kill sleeve, the sleeve includes a pressure sensitive valve which may be opened, by pressurising between the blowout preventer rams, to permit fluid to be pumped from the blowout preventer through the valve and into the string, to choke or kill the well. After the well has been killed, the blowout preventer may be opened to permit removal of the well tools.

According to one aspect of the present invention there is provided a method of providing fluid communication between a blowout preventer stack containing a sub-sea test tree and the inside of a well tool, when at least two sets of rams of the blowout preventer are closed, the method comprising the steps of:

providing a pressure sensitive valve in the well tool between the two sets of closed rams; and pressurising the interior chamber of the blowout preventer between the two sets of closed rams to open the pressure sensitive valve to allow fluid communication between the interior of the blowout preventer and the inside of the well tool.

The open pressure sensitive valve may be used to permit fluid, such as barium mud, brine or seawater to be pumped through the well tool to kill a live well and allow opening of the blowout preventer and retrieval of equipment on the well tool below the blowout preventer.

Preferably, the valve is sensitive to the difference in pressure between the chamber between the rams and the interior of the string, and will only open when the pressure differential is above a predetermined level.

Preferably also, the valve includes a valve member maintained in the closed position by a valve member retaining means which prevents movement of the valve member until predetermined differential pressure force is applied to the valve member. The valve member may be in the form of an annular sleeve, axially slidable within a valve body. Conveniently the valve member retaining means is in the form of a shear pin extending, in the closed position, between the valve body and the valve member.

Preferably the sleeve has a first end surface on which the pressure in the interior chamber of the blowout preventer, and the exterior of the string, acts, and when the valve is opened fluid may flow past this end surface. The valve body preferably includes a low pressure chamber to receive the sleeve as the valve is opened, and the applied pressure acting on the first end surface thus holds the valve open. Conveniently this low pressure chamber contains air at atmospheric pressure.

According to a further aspect of the present invention there is provided a method of killing a live well having a blowout preventer containing a sub-sea test tree and a test string when at least two sets of rams of the blowout preventer are closed and further retrieving the string and equipment below the blowout preventer, the method comprising the steps of:

providing a pressure sensitive valve in the string between the two sets of closed rams;

providing a portion of increased cross-section on the string, above the sub-sea test tree and between the two sets of closed rams, said portion being adapted to open and then engage a descending overshot fishing tool;

pressurising the volume of the blowout preventer between the two sets of closed rams to open the pressure sensitive valve to allow fluid communication between the blowout preventer and the inside of the string; then pumping a sufficient amount of fluid into the blowout preventer and through the valve and sub-sea test tree and into the string to kill the well; then opening the rams of the blowout preventer; then lowering an overshot fishing tool into the blowout preventer to engage the portion of increased cross-section on the string; and then lifting the fishing tool and retrieving the string.

Preferably, the pressure sensitive valve and the portion of increased cross-section are provided by a separate sleeve in the drill string upstream of the sub-sea test tree.

Where the sub-sea test tree includes fail safe valves which may be opened by a preselected tubing pressure applied above the valves, the opening of the pressure sensitive valve permits the pressurising of the interior of the string between the upper set of rams of the blowout preventer and the test tree fail safe valves to open the valves and permit fluid to be pumped into the string below the tree.

According to a still further aspect of the present invention there is provided fluid communication apparatus for location in a string in conjunction with a sub-sea test tree, comprising a sleeve having a sleeve wall defining an inner passage, the sleeve wall including a pressure sensitive valve responsive to a preselected pressure differential across the wall causing the valve to open to allow fluid communication between the exterior of the sleeve and the inner passage.

According to a yet further aspect of the present invention there is provided fluid communication apparatus in combination with a sub-sea test tree for location in a string, the fluid communication apparatus being located upstream of the sub-sea test tree and comprising a sleeve having a sleeve wall defining an inner passage for communicating with an interior passage of the sub-sea test tree, the sleeve wall including a pressure sensitive valve responsive to a preselected pressure differential across the wall causing the valve to open to allow fluid communication between the exterior of the sleeve and the inner passage.

According to another aspect of the present invention there is provided fluid communication apparatus in combination with a sub-sea test tree and a blowout preventer, the apparatus and test tree for forming part of a string and for location in the blowout preventer, the blowout preventer comprising: a wall defining an inner passage for receiving the string, and at least two sets of rams, and the wall including a valve which may be configured to allow fluid communication between the exterior of the wall and the internal passage between the two sets of rams; and the apparatus comprising: a sleeve defining an inner passage and the sleeve including a pressure sensitive valve, a preselected pressure differential across the sleeve causing the valve to open to allow fluid communication between the exterior of the sleeve and the inner passage.

According to a yet another aspect of the present invention there is provided, in combination, fluid communication apparatus for location in a string and for selectively providing fluid communication between the interior and exterior of the string and a sub-sea test tree, wherein the fluid communication apparatus and sub-sea test tree are dimensioned to be located between the pipe rams and the shear rams of a conventional blowout preventer, permitting the rams of the blowout preventer to be activated to seal a well without interfering with the apparatus or the test tree when located in the blowout preventer.

DESCRIPTION OF THE DRAWINGS

These and other aspects of the present invention will now be described, by way of example, with reference to the accompanying drawings, in which.

DETAILED DESCRIPTION OF DRAWINGS

Figure 1:
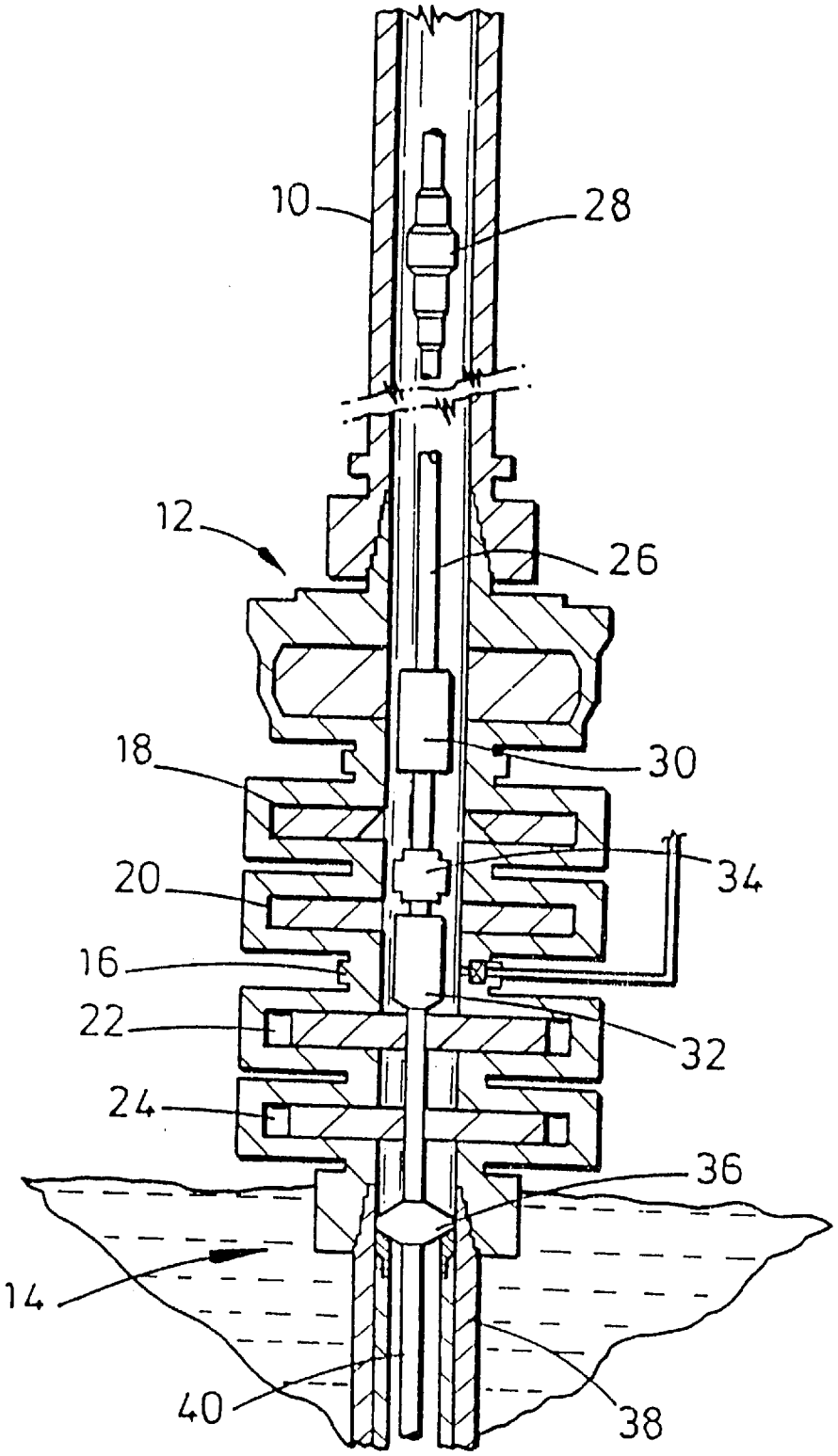
FIGS. 1 and 2 are diagrammatic sectional views of well pressure control equipment including an improved sub-sea test tree in accordance with a preferred aspect of the present invention located in a blowout preventer of a sub-sea oil well.
Figure 2:
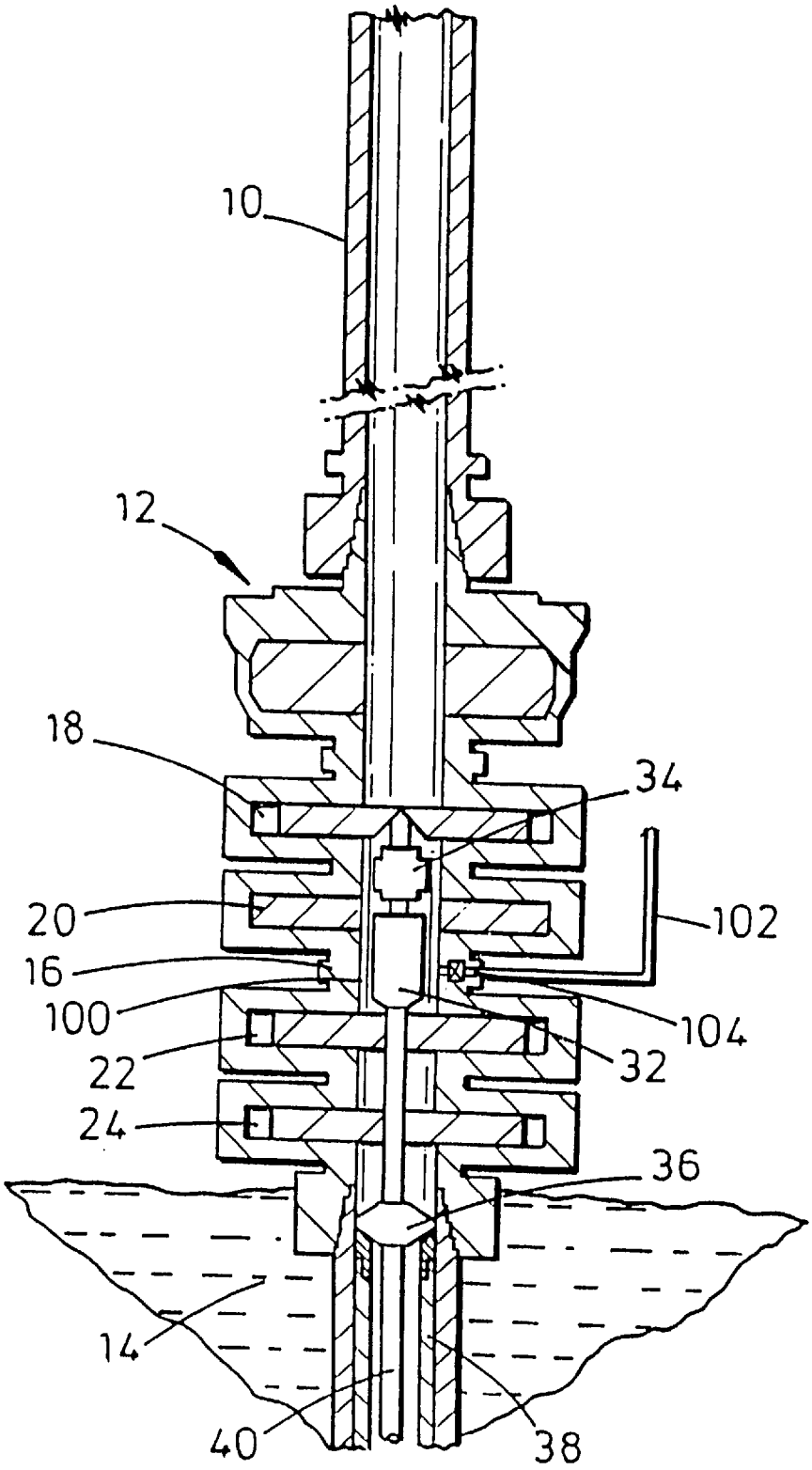

The invention relates to apparatus and methods for use primarily in sub-sea oil and gas exploration and extraction, and in particular relates to improvements to sub-sea test trees, as used in well testing from floating vessels such as semi-submersibles and drillships. FIGS. 1 and 2 of the drawings show, diagrammatically, apparatus provided at a well head during well testing. A riser 10 depends from the drill-ship or semi-submersible (not shown) and is connected to the upper end of a blowout preventer stack 12 mounted on the wellhead 14. The blowout preventer stack 12 includes a generally tubular housing 16 on which are mounted four sets of hydraulic rams 18, 20, 22, 24. In this example, the lower set of rams 22, 24 are in the form of pipe rams provided with semi-circular sealing faces and these rams are normally extended, as shown, to engage with string 26 during well testing. The uppermost set of rams 18 are in the form of shear rams and may be activated to cut through the string 26, when required, as shown in FIG. 2.

Located within the riser 10 and blowout preventer stack 12 and mounted on the landing string 26 is well pressure control equipment including a safe lubricator valve 28, a safe retainer valve 30 and a sub-sea test tree 32 including fluid communication apparatus 34 for providing fluid communication between the blowout preventer 12 and the string 26, as will be later described in detail. The fluid communication apparatus 34 is termed a "kill sleeve" or "kill sub". A hanger assembly 36 sits at the well head 14 on the well head casing 38 and a test string 40 depends from the assembly 36.

The test tree 32 includes fail safe valves (not shown) which may be maintained in the open position by hydraulic pressure. If the hydraulic pressure supply is cut off, the valves will close, isolating the test string 40 below the test tree 32. The valves may be reopened by fluid pressure in the string above the tree, and this allows the valves to be reopened if the hydraulic supply lines have been cut. A sub-sea test tree (SAFE tree) of this form is available from Expro (North Sea) Ltd., Aberdeen, Scotland, U.K. An upper portion of the tree may also be unlatched mechanically or hydraulically from a lower portion containing the valves, to allow the landing string 26 to be withdrawn rapidly and safely in the event of, for example, bad weather.

In situations where a blowout appears likely to occur, the shear rams 18 of the blowout preventer are activated to shear through the landing string 26 above the sub-sea test tree 32 and kill sleeve 34 and seal the well. When a tree 32 provided with fail safe valves as described above is located within the blowout preventer 12 the shear rams 18 will also cut through the hydraulic supply lines which normally hold the valves open. Thus, the valves will close, if they have not already been closed.

To kill or choke the live well to allow the blowout preventer to be reopened and the well test equipment retrieved, it is first necessary to reduce the pressure in the test string and at the well head such that fluid will not flow up from the well and through the string when the blowout preventer is opened. This is normally achieved by pumping relatively high density material, such as barites mud or brine or seawater, into the string.

Figure 3:
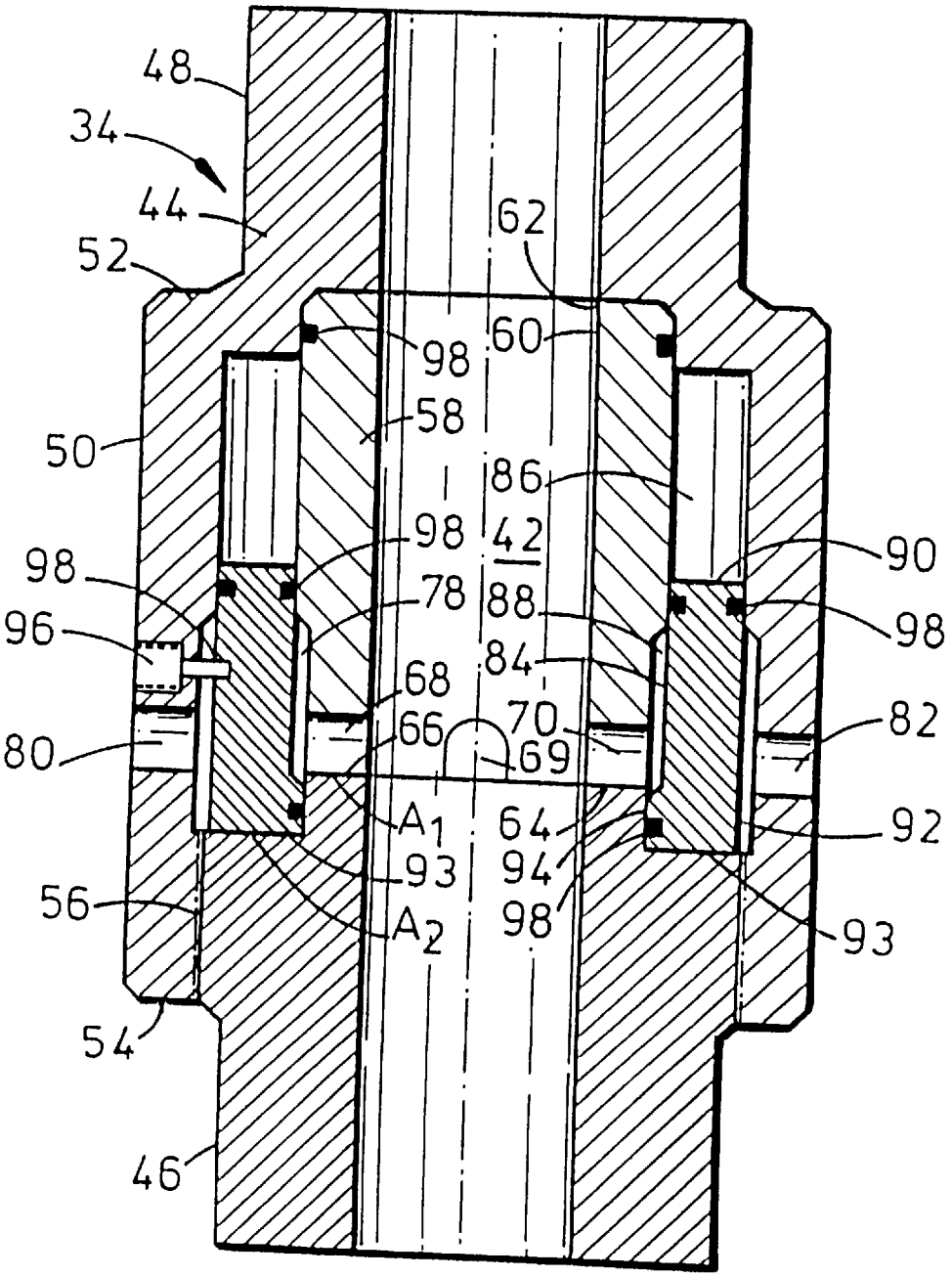
FIGS. 3 and 4 are enlarged diagrammatic sectional views of the fluid communication apparatus of FIG. 1.
Figure 4:
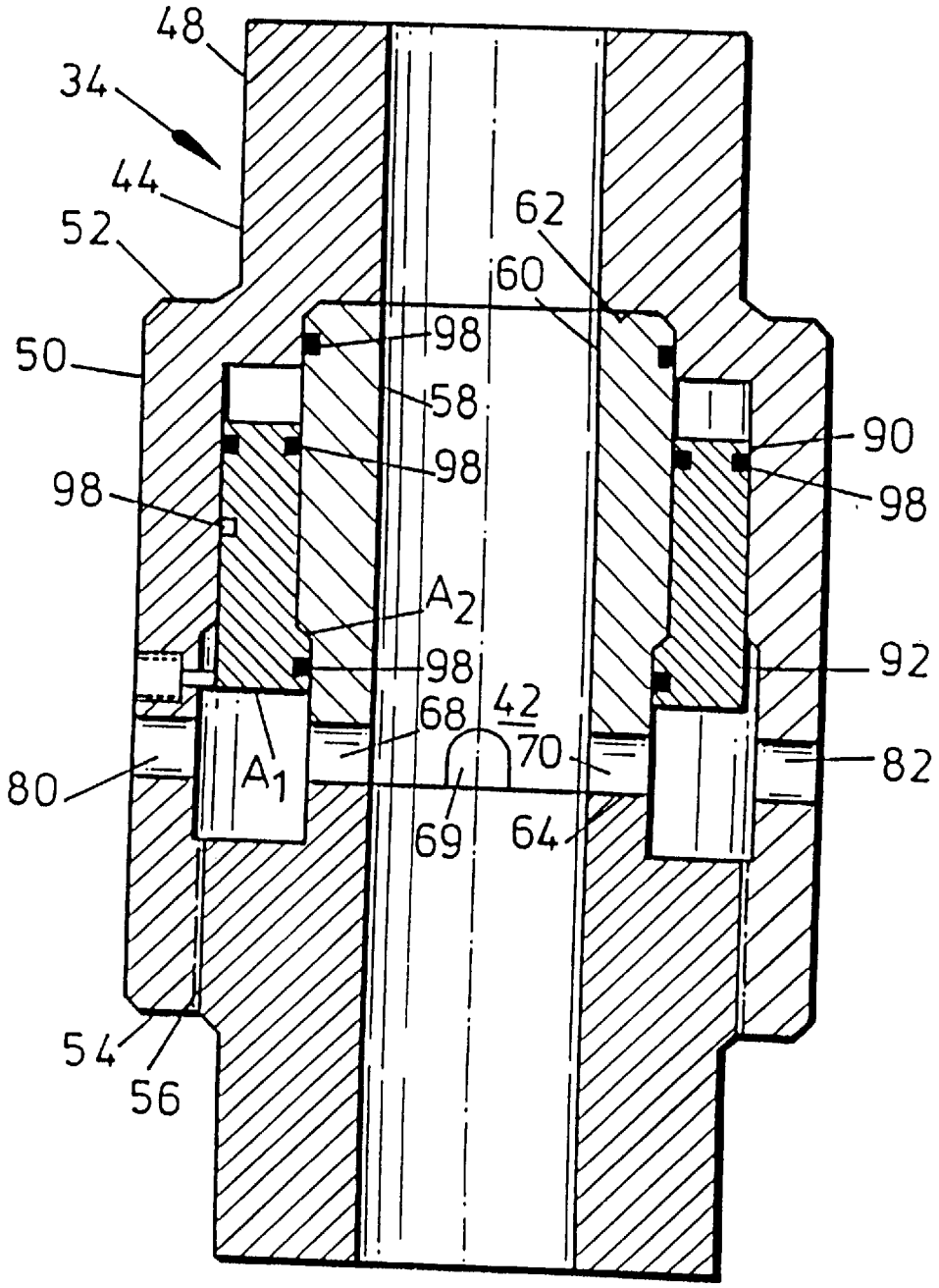

In the present invention this is achieved by means of apparatus, in the form of a kill sleeve 34, as shown in more detail in FIGS. 3 and 4 of the drawings. The kill sleeve 34 forms part of the string 26 and is located above the main body of the sub-sea test tree 32 and, in use, is positioned just below the shear rams 18 of the blowout preventer.

The kill sleeve 34 define an inner passage 42 of similar diameter to the test string inner diameter and the ends of the sleeve are provided with conventional coupling means (not shown), for connecting the sleeve 34 in the string 26.

The sleeve 34 comprises four main parts; an upper portion in the form of a top sub 44; a lower portion in the form of a bottom sub 46; an annular sleeve 58; and a valve member in the form of a further annular sleeve 84. It should be noted that terms upper and lower will be used to facilitate description of the drawings, but that the apparatus described may operate equally well in the opposite orientation. The top sub 44 has an upper portion 48 and a lower portion 50 of greater diameter. As will be described, the shoulder 52 between the portions 48, 50 may be used to locate an overshot fishing tool, while the lower shoulder 54 of the portion 50 provides a surface to engage the fishing tool.

The subs 44, 46 are joined by means of a threaded connection 56 on the inner surface of the lower portion 50 of top sub 44 and the outer surface of the upper end of the bottom sub 46.

Located between the subs 44, 46 and defining a portion of the inner passage 42 is a fixed annular sleeve 58. The upper end 60 of the sleeve 58 is received in an annular groove 62 in the top sub 44 while the lower end 64 abuts a face 66 of the bottom sub 46. The lower end 64 of the sleeve 58 is castellated, that is provided with four equi-spaced grooves (90° apart) around its circumference to define four passages 68, 69, 70 (only three shown) between the inner passage 42 and an annular chamber 78 formed between the sleeve 58 and the subs 44, 46. Four further passages 80, 82 (only two shown) are provided in the sleeve wall of the lower portion 50 of the top sub 44, and together with the passages 68, 70 define circulation ports, normally closed by a valve member in the form of an annular sleeve 84 located in the chamber 78. FIG. 3 shows the annular sleeve 84 positioned to close the circulation ports, while FIG. 4 shows the sleeve 84 raised so that the circulation ports are open.

The sleeve 84 is slidable in the annular chamber 78 which defines an upper portion 86 at low or atmospheric pressure and an enlarged lower portion 88 between the passages 68, 70 and 80, 82. The circulation sleeve 84 is normally located with its upper end 90 located in the lower end of the upper portion 86 of the chamber 78 and its lower end 92 abutting the base 93 of the lower portion 88 of the chamber 78. The lower end of the sleeve includes a shoulder 94 which seals against an inner side wall of the chamber 78.

A shear pin 96 is mounted on the top sub 44 and extends into a recess 98 in the outer wall of the sleeve 84. The sleeve 84 is further held in the closed position by means of the pipe pressure, from the interior of the string, exerted over area $A_1$. Acting to move the sleeve 84 to open the circulation ports is the annular pressure, between the interior of the blowout preventer and the string, acting on area $A_2$; in a live well the annular pressure is normally substantially lower than the pipe pressure. It will be noted that area $A_2$ is substantially larger than area $A_1$, such that the "upward" pressure force acting over area $A_2$ will be greater than the "downward" pressure force acting over area $A_1$ when the annulus pressure is still substantially lower than the tubing pressure.

In the preferred embodiment, the kill sleeve 34 is formed from K-500 Monel (trade mark) metal, and three O-ring seals 98 provided on the sleeve are formed of an elastomer, preferably Viton (trade mark), and the shear pin 96 is preferably of aluminium-bronze.

In order to accommodate the sub-sea test tree 32 and the kill sleeve 34 within the blowout preventer 12 below the shear rams 18 the kill sleeve 34 is of a minimum length, preferably around 12" long, and typically has an inside diameter of 3" and an outside diameter of 8".

In use, the kill sleeve 34 is utilised after the shear rams 18 of the blowout preventer have been activated to cut through the string 26, as may be seen in FIG. 2. The sleeve 84 allows fluid communication between the volume 100 of the blowout preventer between the shear rams 18 and the lower sets of rams 22, 24 and the interior of the drill string, to permit operators to choke or kill the well. This is achieved by pressurising the volume 100 by pumping fluid from the surface through the supply lines 102 and a valve 104 (FIG. 2) in the blowout preventer housing 16. Once the pressure in the volume reaches a predetermined level, the annular pressure force on the area $A_2$ is sufficient to overcome the pipe pressure force on the area $A_1$, and shear the pin 96 to move the circulation sleeve 84 into the upper portion 86 of the chamber 78 and open the circulation ports. The pressure in the volume 100 and now also the string above the test tree 32 is then used to open the closed ball valves in the sub-sea test tree 32. Fluid, such as barites mud, brine or sea water may then be pumped through the circulation ports of the kill sleeve, into the string and through the test tree 32 until the pipe pressure at the well head falls to a level, usually zero, to permit the blowout preventer to be opened by retracting the rams 18, 22, 24. The kill sleeve 34, test tree 32, hanger assembly 36 and test string 40 carrying the downhole test equipment may then be retrieved by means of an overshot fishing tool which, as it descends, is located by the enlarged cross-section portion of the sleeve 34, at the shoulder 52 and then latches around this portion, at the lower shoulder 54.

Thus it may be seen that the above described kill sleeve, in conjunction with the other apparatus, provides means for quickly killing a well after actuation of a blowout preventer and which permits retrieval of the apparatus from a well.

It will be clear to those of skill in the art that the above described embodiment is merely exemplary of the present invention, and that various modifications and improvements may be made without departing from the scope of the invention; the blowout preventer described, and the vast majority of existing blowout preventers, operate using hydraulic rams, however other means of closing a well may be developed and it is clear that the kill sleeve described may operate in conjunction with blowout preventers of other forms.

We claim:

1. A method of providing fluid communication between a blowout preventer stack defining an internal chamber and a well tool located in said chamber and defining an internal bore, when at least two sets of rams of the blowout preventer are closed and the well tool forms part of a tubular test string including a sub-sea test tree and defining an internal bore in communication with the internal bore of the well tool, the method comprising the steps of:

providing a pressure sensitive valve in the well tool between the two sets of closed rams; and pressurising the internal chamber of the blowout preventer between the two sets of closed rams to open the pressure sensitive valve and permit fluid communication between the internal chamber of the blowout preventer and the well tool internal bore.

2. A method as claimed in claim 1 wherein the open pressure sensitive valve is used to permit fluid, such as barium mud, brine or seawater to be pumped through the well tool to kill a live well and allow opening of the blowout preventer and retrieval of equipment on the well tool below the blowout preventer.

3. A method as claimed in claim 1 wherein the valve is sensitive to a difference in pressure between the internal chamber of the blowout preventer between the rams and the internal bores of the well tool and the string and will only open when the pressure differential is above a predetermined level.

4. A method as claimed in claim 1 wherein the valve includes a valve member maintained in the closed position by a valve member retaining means which prevents movement of the valve member until a predetermined differential pressure force is applied to the valve member.

5. A method as claimed in claim 4 wherein the valve member is in the form of an annular sleeve, axially slidable within a valve body.

6. A method as claimed in claim 5 wherein the sleeve has a first end surface on which the pressure in the internal chamber of the blowout preventer, and the exterior of the string, acts, and when the valve is opened fluid flows past this and surface.

7. Fluid communication apparatus in combination with a sub-sea test tree for location in a tubular string defining a string bore, the fluid communication apparatus being located upstream of the sub-sea test tree and comprising a sleeve having a sleeve wall defining an external string surface and an inner passage for communicating with an internal passage of the sub-sea test tree, the sleeve wall including a pressure sensitive valve responsive to a preselected pressure differential across the wall causing the valve to open to allow fluid communication between the external string surface and the inner passage, wherein the sub-sea test tree includes fail safe valves which are opened by a preselected tubing pressure applied above the valves, the opening of the pressure sensitive valves permitting the pressurising of the string bore between an upper set of rams of the blowout preventer and the test tree fail safe valves to open the valves and permit fluid to be pumped into the string below the tree.

8. A method of providing fluid communication between a blowout preventer stack defining an internal chamber and a well tool located in said chamber and defining an internal bore, when at least two sets of rams of the blowout preventer are closed and the well tool forms part of a tubular test string including a sub-sea test tree and defining an internal bore in communication with the internal bore of the well tool, providing a pressure sensitive valve in the well tool between the two sets of closed rams, the valve including a valve member in the form of an annular sleeve, axially slidable within a valve body and having a first end surface, said valve member maintained in the closed position by a valve member retaining means which prevents movement of the valve member until a predetermined differential pressure force is applied to the valve member, wherein the valve body includes a low pressure chamber for receiving the sleeve as the valve is opened, and the applied pressure acting on the first end surface thus holds the valve open.

9. Fluid communication apparatus in combination with a sub-sea test tree for location in a tubular string defining a string bore, the fluid communication apparatus being located upstream of the sub-sea test tree and comprising a sleeve having a sleeve wall defining an external string surface and an inner passage for communicating with an internal passage of the sub-sea test tree, the sleeve wall including a pressure sensitive valve responsive to a preselected pressure differential across the wall causing the valve to open to allow fluid communication between the external string surface and the inner passage.

10. A method of killing a live well having a blowout preventer containing a sub-sea test tree and a test string when at least two sets of rams of the blowout preventer are closed and further retrieving the string and equipment below the blowout preventer, the method comprising the steps of:

providing a pressure sensitive valve in the string between the two sets of closed rams;

providing a portion of increased cross-section on the string, above the sub-sea test tree and between the two sets of closed rams, said portion being adapted to open and then engage a descending overshot fishing tool;

pressurising the volume of the blowout preventer between the two sets of closed rams to open the pressure sensitive valve to allow fluid communication between the blowout preventer and the inside of the string; then pumping a sufficient amount of fluid into the blowout preventer and through the valve and sub-sea test tree and into the string to kill the well; then opening the rams of the blowout preventer; then lowering an overshot fishing tool into the blowout preventer to engage the portion of increased cross-section on the string; and then lifting the fishing tool and retrieving the string.

11. A method of killing a live well having a blowout preventer containing a sub-sea test tree and a test string when at least two sets of rams of the blowout preventer are closed and further retrieving the string and equipment below the blowout preventer, the method comprising the steps of:

providing a pressure sensitive valve in the string between the two sets of closed rams;

providing a portion of increased cross-section on the string, above the sub-sea test tree and between the two sets of closed rams, said portion being adapted to open and then engage a descending overshot fishing tool;

pressurising the volume of the blowout preventer between the two sets of closed rams to open the pressure sensitive valve to allow fluid communication between the blowout preventer and the inside of the string; then pumping a sufficient amount of fluid into the blowout preventer and through the valve and sub-sea test tree and into the string to kill the well; then opening the rams of the blowout preventer; then lowering an overshot fishing tool into the blowout preventer to engage the portion of increased cross-section on the string; and then lifting the fishing tool and retrieving the string, wherein the sub-sea test tree includes fail safe valves which are opened by a preselected tubing pressure applied above the valves, the opening of the pressure sensitive valves permitting the pressurizing of the interior of the string between an upper set of rams of the blowout preventer and the test tree fail safe valves to open the valves and permit fluid to be pumped into the string below the tree.

12. A fluid communication apparatus for forming part of a tubular test string defining a string bore and for location in a sub-sea test tree, the apparatus comprising:

a tubular body having end couplings for connecting the body in a string, the body defining an inner passage for forming a portion of a string bore and having an external wall defining a string outer surface; and a pressure sensitive valve provided in the body and defining a valve port permitting fluid communication between the string outer surface and the inner passage, the valve being responsive to a pressure differential between said outer surface and said inner passage to provide selective fluid communication through said valve port.

13. Apparatus as claimed in claim 12 wherein the valve includes a valve member maintained in the closed position by a valve member retaining means which prevents movement of the valve member until said predetermined differential pressure is applied to the valve member.

14. Apparatus as claimed in claim 13 wherein the valve member retaining means is in the form of a shear pin.

15. Apparatus as claimed in claim 13 wherein the valve includes a valve member in the form of an annular sleeve, axially slidable within a valve body.

16. Apparatus as claimed in claim 15 wherein the sleeve has a first end surface on which an external pressure acts, and when the valve is opened fluid flows past this first end surface.

17. Apparatus as claimed in claim 16 wherein the valve body includes a low pressure chamber for receiving the sleeve as the valve is opened, and the applied pressure acts on the first and surface to-hold the valve open.

* * * * *